US007449842B2

(12) United States Patent
Miyazaki et al.

(10) Patent No.: US 7,449,842 B2
(45) Date of Patent: Nov. 11, 2008

(54) DISCHARGE TUBE DRIVE CIRCUIT

(75) Inventors: Hiroyuki Miyazaki, Chuo-ku (JP); Takeshi Hatakeyama, Chuo-ku (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 11/694,321

(22) Filed: Mar. 30, 2007

(65) Prior Publication Data

US 2007/0228987 A1 Oct. 4, 2007

(30) Foreign Application Priority Data

Apr. 4, 2006 (JP) ..... 2006-103480

(51) Int. Cl.
*H05B 41/16* (2006.01)

(52) U.S. Cl. ..... 315/276; 315/224; 315/277; 315/312

(58) Field of Classification Search ..... 315/209 R, 315/224, 246, 276–277, 291, 307, 312
See application file for complete search history.

(56) References Cited

U.S. PATENT DOCUMENTS

| | | | | |
|---|---|---|---|---|
| 6,104,146 | A * | 8/2000 | Chou et al. | 315/277 |
| 6,310,444 | B1 | 10/2001 | Chang | 315/282 |
| 6,717,372 | B2 | 4/2004 | Lin et al. | |
| 6,781,325 | B2 | 8/2004 | Lee | 315/282 |
| 7,109,667 | B2 * | 9/2006 | Matsushima et al. | 315/224 |
| 7,166,969 | B2 * | 1/2007 | Kohno | 315/209 PZ |
| 7,250,731 | B2 * | 7/2007 | Jin | 318/282 |
| 2003/0001524 | A1 | 1/2003 | Lin et al. | |
| 2004/0183448 | A1 | 9/2004 | Hsueh et al. | |
| 2004/0257003 | A1 | 12/2004 | Hsieh et al. | |
| 2005/0285548 | A1 * | 12/2005 | Moyer et al. | 315/312 |
| 2006/0284568 | A1 * | 12/2006 | Chang et al. | 315/282 |
| 2007/0029944 | A1 * | 2/2007 | Wu | 315/220 |
| 2007/0126369 | A1 * | 6/2007 | Meng et al. | 315/282 |
| 2007/0247082 | A1 * | 10/2007 | Ashikaga et al. | 315/277 |
| 2007/0267979 | A1 * | 11/2007 | Jin | 315/268 |
| 2008/0061708 | A1 * | 3/2008 | Wi et al. | 315/277 |
| 2008/0129218 | A1 * | 6/2008 | Shinmen et al. | 315/280 |

FOREIGN PATENT DOCUMENTS

| | | |
|---|---|---|
| EP | 1615481 | 1/2006 |
| JP | 2003-031383 | 1/2003 |
| WO | 02/13581 | 2/2002 |
| WO | 2005/038828 | 4/2005 |

* cited by examiner

*Primary Examiner*—David Hung Vu
*Assistant Examiner*—Tung X Le
(74) *Attorney, Agent, or Firm*—Coats & Bennett, PLLC

(57) ABSTRACT

A discharge tube drive circuit for driving a plurality of discharge tubes is proposed with reduced number of parts and in a down-sized form. A first balance transformer is provided in a first drive circuit block, and a plurality of primary coils of a plurality of drive transformers in the first drive circuit block and a secondary coil of the first balance transformer are connected in series. A second balance transformer is provided in a second drive circuit block, and a plurality of primary coils of a plurality of drive transformers in the second drive circuit block and a secondary coil of the second balance transformer are connected in series. Further, a primary coil of the balance transformer and a primary coil of the second balance transformer are connected in series to configure the discharge tube drive circuit of the present invention.

11 Claims, 8 Drawing Sheets

DISCHARGE TUBE DRIVE CIRCUIT

BACKGROUND OF THE INVENTION

1. Field of the Invention

The present invention relates to discharge tube drive circuits for controlling emission of cold cathode discharge tubes such as fluorescent lamps, and more particularly to discharge tube drive circuits that employ a plurality of drive transformers for driving a plurality of cold cathode discharge tubes.

2. Description of the Related Art

As well known, cold cathode discharge tubes such as fluorescent lamps emit lights by being driven with high frequency drive voltages generated in an inverter. A cold cathode discharge tube of this type is used for lighting purpose, and is also used for a backlight source of a LCD panel, recently. For this purpose, drive transformers are provided at output side of switching circuit included in a discharge tube drive circuit, and cold cathode discharge tubes are connected to output terminals of a secondary coil side in the drive transformers by way of connectors.

Particularly, in case of using cold cathode discharge tubes for backlight of a LCD panel, a plurality of cold cathode discharge tubes is employed, and the cold cathode discharge tubes must emit uniformly.

It has been already known to uniformly control the currents flowing through a plurality of cold cathode discharge tubes by connecting balance transformers to a low voltage side of the cold cathode discharge tubes or by connecting balance transformers to a high voltage side of the cold cathode discharge tubes.

Further, a voltage across electrodes of a cold cathode discharge tube becomes uneven due to unevenness of impedance values of a plurality of cold cathode discharge tubes. Therefore, a current flowing through each cold cathode discharge tube becomes different value, and luminosity of emitting cold cathode discharge tubes becomes different. Accordingly, in case of using cold cathode discharge tubes for backlight of the LCD panel, unevenness of luminosity in a LCD panel occurs, so that it is necessary to control current flowing through the cold cathode discharge tubes to be uniform.

As mentioned above, it has been already introduced technology in manufacturers to uniformly control the currents flowing through a plurality of cold cathode discharge tubes by connecting balance transformers to a low voltage side of the cold cathode discharge tubes, or by connecting balance transformers to a high voltage side of the cold cathode discharge tubes. Due to unevenness of impedance values of the discharge tubes or due to unevenness of stray capacitance between an LCD panel and the cold cathode discharge tubes, even the same drive voltage is applied to all cold cathode discharge tubes, the currents flowing through each cold cathode discharge tube do not become the same. In an LCD-TV, a screen size of the LCG panel has been larger, so that, a plurality of cold cathode discharge tubes is required per one LCD panel. Accordingly, unevenness of luminosity in the LCD-TV tends to occur by the differences of the amount of the current flowing through each cold cathode discharge tube, so that it is essential to adjust the current flowing through each cold cathode discharge tube to be the same.

Conventionally, it is proposed to connect a balance transformer to a low voltage side and/or a high voltage side of a cold cathode discharge tube. However, in this case, it requires (N−1) balance transformers relative to N cold cathode discharge tubes, or it requires a plurality of coils on a magnetic path of a balance transformer corresponding to the number of the cold cathode discharge tubes such as disclosed in Japanese Patent Laid-Open No. 2003-31383 and U.S. Pat. No. 6,781,325. However, if (N−1) balance transformers are employed relative to N cold cathode discharge tubes, these balance transformers occupy a large space and a circuit board becomes larger. Further in such a balance transformer including coils corresponding the number of the cold cathode discharge tubes in one magnetic path, there is a problem where the size of the balance transformer itself becomes larger.

Further in PCT International Publication No. WO2005/038828, primary coils of balance transformers are connected to cold cathode discharge tubes, respectively, and each secondary coil of each balance transformer is configured to be a circuit forming a closed loop. Further in the above PCT publication, it is disclosed that a plurality of cold cathode discharge tubes is connected in parallel to outputs of the drive transformers, and when one of the cold cathode discharge tubes is not activated, the balance transformers work to boost the voltage of the portion.

However, once balance transformers are provided at secondary coil side of a drive transformer, it is necessary to consider insulation since the secondary coils generate high voltage, so that it is also necessary to consider layouts of components upon circuit board design. In addition, the same number or a half number of the balance transformers with compared to the number of the cold cathode discharge tubes are to be used, so that these balance transformers occupied a large area on the circuit board. Published Japanese translation of PCT International Publication for patent application No. 2004-506294 also discloses a similar drive circuit.

SUMMARY OF THE INVENTION

The present invention is characterized by connecting balance transformers at primary coils of the drive transformers and by controlling currents flowing through the primary coils of the drive transformers, so that currents flowing through each of cold cathode discharge tubes are indirectly controlled to be the same. Further, according to the present invention, it is not necessary to consider insulation in case of the layout of components because balance transformers are provided at primary coils of the drive transformers, so that the circuit board design becomes easy and effective. In addition, the number of the components can be reduced and it become possible to drive the cold cathode discharge tubes with the reduced number of the components in practice.

Accordingly, an object of the present invention is to provide a discharge tube drive circuit capable of driving a plurality of discharge tubes for uniformly emitting lights.

In order to achieve above-mentioned object, an embodiment of a discharge tube drive circuit according to the present invention is a discharge tube drive circuit which comprises:

- a first and a second drive circuit blocks each having a plurality of drive transformers;
- a plurality of switches for generating high frequency signals; and
- a control unit for controlling the plurality of switches, wherein
- the first drive circuit block includes a first balance transformer; wherein
- a plurality of primary coils of the plurality of drive transformers in the first drive circuit block and a secondary coil of the first balance transformer are connected in series;
- the second drive circuit block includes a second balance transformer;

a plurality of primary coils of the plurality of drive transformers in the second drive circuit block and a secondary coil of the second balance transformer are connected in series; and the primary coil of the first balance transformer and the primary coil of the second balance transformer are connected in series.

In order to achieve above-mentioned object, another embodiment of a discharge tube drive circuit according to the present invention is a discharge tube drive circuit including a plurality of drive transformers for driving a plurality of discharge tubes which comprises:

at least two drive circuit blocks being formed by dividing the plurality of drive transformers, and including a balance transformer, respectively, wherein primary coils of the drive transformer are connected in series to a secondary coil of the balance transformer in each of the drive circuit blocks; and one of terminals of a primary coil of the balance transformer is connected to an output terminal of an inverter including a plurality of switches in each of the drive circuit blocks.

In order to achieve above-mentioned object, a further embodiment of a discharge tube drive circuit according to the present invention is a discharge tube drive circuit for driving a LCD panel having a plurality of discharge tubes which comprises:

a plurality of drive circuit blocks for lighting the plurality of discharge tubes, wherein each of the plurality of drive circuit blocks includes a plurality of drive transformers in which primary coils of the drive transformers are connected in series; and each of the plurality of drive circuit blocks includes a balance transformer in which a secondary coil of the balance transformer and the primary coils of the drive transformers are connected in series in order to conform currents flowing through the each of the drive circuit blocks.

In order to achieve above-mentioned object, a still further embodiment of a discharge tube drive circuit according to the present invention is a discharge tube drive circuit for lighting a plurality of discharge tubes which comprises:

a plurality of drive circuit blocks, wherein each of the drive circuit blocks includes a plurality of drive transformers; and primary coils of the drive transformers are connected in series.

According to the present invention, it is possible to conform currents flowing through primary coils of drive transformers by connecting primary coils of a plurality of drive transformers in series. Further by conforming the currents of drive circuit blocks, it is possible to provide a discharge tube drive circuit capable of stably driving a plurality of cold cathode discharge tubes with reduced number of balance transformers. Further, the balance transformer includes a boost function, so that it is possible to perform the boost function with the balance transformers in a circuit where primary coils of the drive transformers are connected in series, it is also possible to boost voltages by the balance transformers in the circuit where primary coils of the drive transformers are connected in series without increasing turn ratio of the drive transformers.

Further features of the present invention will become apparent from the following description of exemplary embodiments with reference to the attached drawings.

DESCRIPTION OF THE EMBODIMENTS

First Embodiment

At first, a discharge tube drive circuit for driving 4 cold cathode discharge tubes L1 to L4 according to a first embodiment of the present invention will be explained with reference to FIG. 1. A DC voltage Vin is supplied between power source terminals 1 and 2 in FIG. 1, and a high frequency drive voltage is generated as output signals through a full-bridge type switching circuit that is configured with four transistors TR1 to TR4. In this case, the power source terminal 2 is connected to ground. In the switching circuit, the four transistors TR1 to TR4 are controlled with switching pulses from a control unit 3. An output from the switching circuit is boosted at drive transformers T1 to T4 to high voltages, and are supplied to discharge tubes FL1 to FL4 as high frequency drive voltage to drive the discharge tubes.

As well known, the control unit 3 includes a variable frequency oscillator circuit therein, and an oscillation frequency of the variable frequency oscillator circuit is controlled by an F/B signal that is related to current flowing through the cold cathode discharge tubes F11 to FL4 to be lit. Thereby it becomes possible to light the cold cathode discharge tubes stable.

Figure 1:
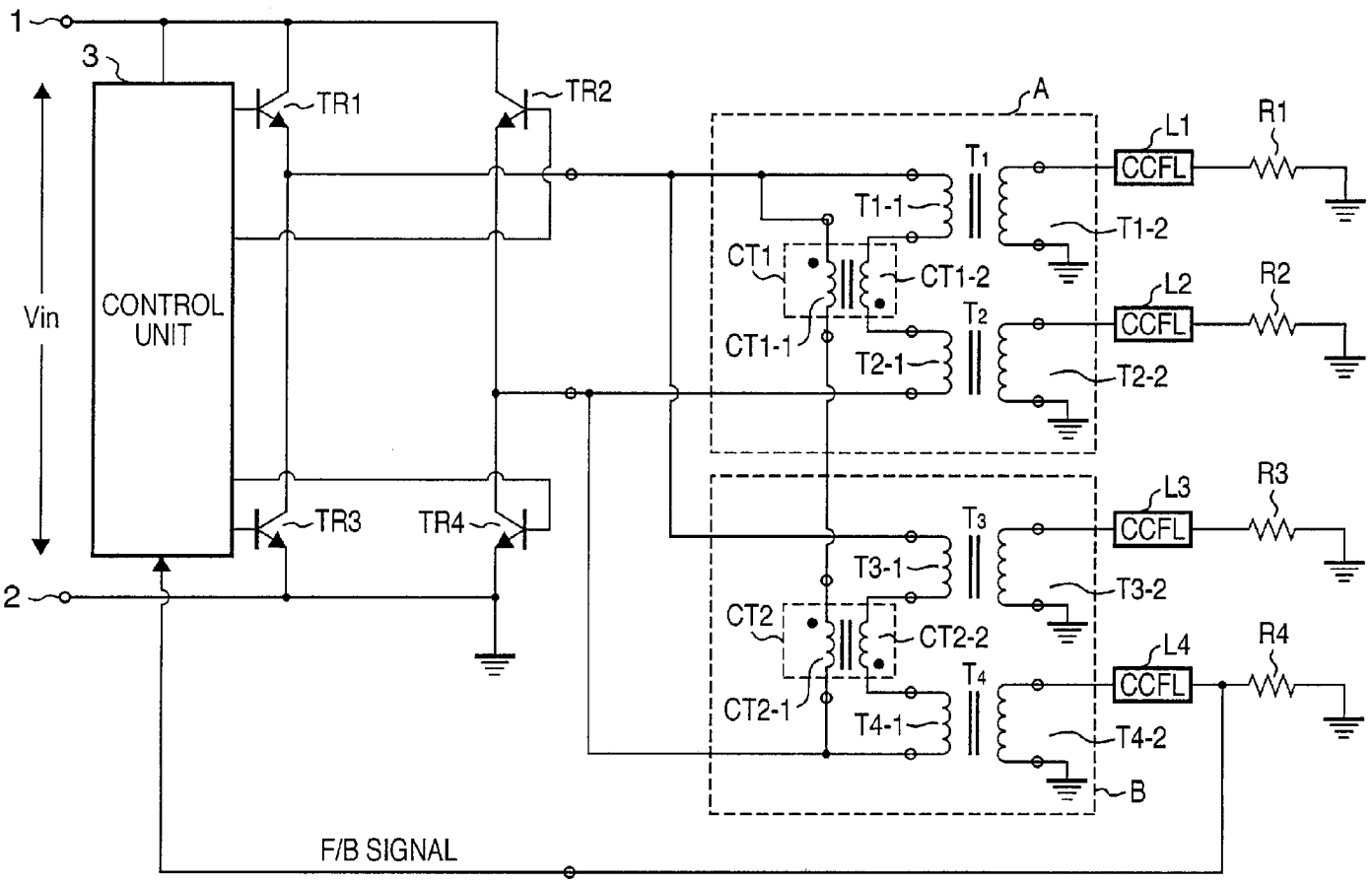
FIG. 1 shows a circuit diagram of a discharge tube drive circuit according to a first embodiment of the present invention.

The discharge tube drive circuit in FIG. 1 is configured to include two drive circuit blocks A and B. The drive circuit block A comprises two drive transformers T1 and T2, and one balance transformer CT1. A primary coil T1-1 of the drive transformer T1 and a primary coil T2-1 of the drive transformer T2 are connected in series with a secondary coil CT1-2 of the balance transformer CT1 in-between. One of ends of the series-connection is connected to a connection point between the transistors TR1 and TR3, and the other is connected to a connection point between the transistors TR2 and TR4, respectively. Both ends of the series-connection are connected to a connecting mid-point of the transistors TR1 and TR3, and the transistors TR2 and TR4, respectively.

Further, in the secondary coil T1-2 of the drive transformer T1, one of terminals is connected to ground through series-connected cold cathode discharge tube L1 and resistor R1, and the other is connected directly to ground. Similarly, the secondary coil T2-2 of the drive transformer T2 is connected to ground through series-connected cold cathode discharge tube L2 and resistor R2, and the other is connected directly to ground.

Further, the drive circuit block B is configured to include two drive transformers T3 and T4, and one balance transformer CT2. The primary coil T3-1 of the drive transformer T3 and the primary coil T4-1 of the drive transformer T4 are connected in series while sandwiching the secondary coil CT2-2 of the balance transformer CT2. Both ends of the series-connection are connected to connecting mid-point of the transistors TR1 and TR3, and transistors TR2 and TR4. Further in the secondary coil T3-2 of the drive transformer T3, one of terminals is connected to ground through a series circuit of the old cathode discharge tube L3 and the resistor R3, and another is connected directly to ground. Similarly, in the secondary coil T4-2 of the drive transformer T4, one of terminals is connected to ground through a series circuit of the cold cathode discharge tube L4 and the resistor R4, and another is connected directly to ground.

The primary coil CT1-1 of the balance transformer CT1 provided in the drive circuit block A and the primary coil CT2-1 of the balance transformer CT2 provided in the drive circuit block B are connected in series. Both ends of the series-connection are connected to a connecting mid-point of the transistors TR1 and TR3 and a connecting mid-point of transistors TR2 and TR4, respectively.

Now, an operation of the discharge tube drive circuit according to the first embodiment is described. When the voltage Vin is supplied from a full-bridge type switching circuit, a voltage Vin/2 is applied across each of primary coils of the drive transformers T1, T2, T3 and T4, and also the voltage Vin/2 is applied across each of the primary coils CT1-1 and CT2-1 of the balance transformers CT1 and CT2.

In the case where the voltage Vin/2 is applied to primary coils of each drive transformer, it is necessary to increase the number of turns of the secondary coil or to decrease the number of turns of the primary coil to increase a turn ratio as a drive transformer from 1:n to 1:2×n, for example, with compared to the case where the voltage Vin is applied. Otherwise, the same output is not obtained. However, such increase of the turn ratio causes deterioration of efficiency as a drive transformer. Therefore, the voltage Vin/2 is applied to each of the drive transformers by way of the balance transformer according to the present invention. This configuration enables to obtain the same output with compared to the case where the voltage Vin is applied without increasing the turn ratio as a transformer.

The primary coils T1-1 and T2-1 of the drive transformers T1 and T2 and the primary coils T3-1 and T4-1 of the drive transformers T3 and T4 are connected in series, respectively. Therefore, current flowing through the primary coils of each of the drive transformers in each of drive circuit blocks A and B, so that the currents flowing through each of the drive circuit blocks A and B are made equal to each other, since the primary coils of the are balance transformers are also connected in series. Accordingly, the currents following through all primary coils T1-1 to T4-1 of the drive transformers T1 to T4 become equal to each other.

For example, in the first embodiment in FIG. 1, a turn ratio of the primary coil and secondary coil of each of balance transformers is configured to be 1:2. In this case, when a voltage Vin/2 is applied to the primary coil CT1-1 of the balance transformer CT1, a voltage −Vin is derived from the secondary coil CT1-2 of the balance transformer CT1. Further the voltage Vin from the switching circuit is divided, so that the voltage Vin/2 is applied to the primary coils T1-1 and T2-1 of the drive transformers T1 and T2. Accordingly, by the voltage Vin/2 applied to the primary coil T1-1, the voltage Vin/2 applied to the primary coil T2-1, and the voltage −Vin from the secondary coil CT1-2 of the balance transformer CT1, a voltage Vin/2−(−Vin/2 )=Vin is to be applied to the primary coil T1-1 of the drive transformer T1. Similarly, the voltage Vin/2−(−Vin/2 )=Vin is also to be applied to the primary coil T2-1 of the drive transformer T2. In this case, the voltage applied to both the drive transformers T1 and T2 lacks by Vin/2, so that each turn ratio of a primary coil and a secondary coil in the balance transformers CT1 and CT2 is configured to be 1:2 in order to output the voltage Vin=2×Vin/2.

With regard to the turn ratio, it is possible to design the turn ratio depending on desired voltage to be applied to the drive transformers T1 and T2, and accordingly, it is not necessary to configure the turn ratio of the balance transformers to be 1:2. In addition, with regard to the currents flowing through the cold cathode discharge tube L1 connected to the drive transformer T1 and the cold cathode discharge tube L2 connected to the drive transformer T2, the currents flowing through the primary coils are made constant, since the primary coils T1-1 and T2-1 of the drive transformers T1 and T2 are connected in series. Accordingly, the currents flowing through the cold cathode discharge tubes L1 and L2 are indirectly conformed to each other.

With regard to the drive circuit block B, its operation is basically the same with the operation of the drive circuit block A described above, so that the description for the drive circuit block B is omitted.

Further, a connecting mid-point of the cold cathode discharge tube L4 and the resistor R4 is fed back to the control section 3 as a F/B signal, the luminosity of these cold cathode discharge tubes L1 to L4 is controlled to be stable. This F/B signal may be derived any one of the cold cathode discharge tubes L1 to L4.

With regard to the drive circuit block A and the drive circuit block B, they function to conform currents by the balance transformers CT1 and CT2 in order to conform each of currents flowing through the cold cathode discharge tubes. Since the primary coils CT1-1 and CT2-1 of the balance transformers CT1 and CT2 are connected in series, the currents flowing through the secondary coils CT1-2 and CT2-2 become equal to each other. Therefore, the currents flowing through the drive transformers T1, T2, T3, and T4 are made equal to each other. As described above, it is possible to reduce the number of balance transformers by providing balance transformers in the primary coil side of the drive transformers with compared to a case where the balance transformers are connected to cold cathode discharge tube side.

For example, in case where balance transformers are directly connected to cold cathode discharge tubes, three balance transformers are necessary for four straight-type cold cathode discharge tubes.

However, according to the first embodiment of the present invention, it is possible to configure a drive circuit with two balance transformers by providing the balance transformers in its primary coil side of the drive transformers in the embodiment shown in FIG. 1.

Second Embodiment

Figure 2:
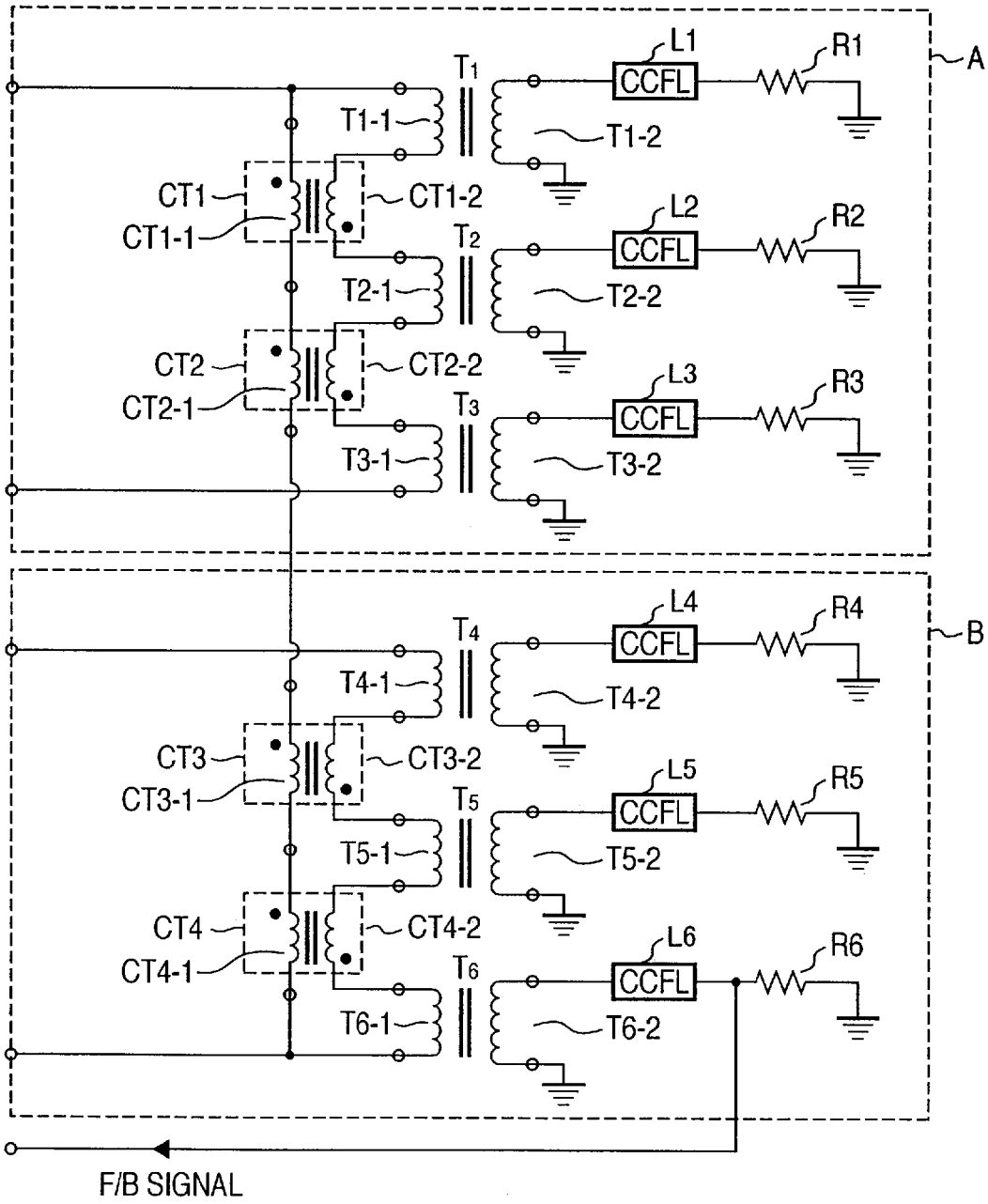
FIG. 2 shows a circuit diagram of a discharge tube drive circuit according to a second embodiment of the present invention.

Now, with reference to FIG. 2, a discharge tube drive circuit for driving six cold cathode discharge tubes L1 to L6 according to a second embodiment of the present invention is described. In a discharge tube drive circuit in the embodiment shown in FIG. 2, the control circuit 2 and the switching circuit are neglected, since they are common to the components used in the first embodiment. Basic ideas for the second embodiment is common to the first embodiment, so that descriptions for the second embodiment are neglected. That is, similar to the first embodiment, the discharge tube drive circuit according to the second embodiment of the present invention is configured to include two drive circuit blocks A and B. The drive circuit block A is configured to include three drive transformers T1, T2 and T3, and two balance transformers CT1 and CT2. A primary coil T1-1 of a drive transformer T1, a secondary coil CT1-2 of a balance transformer CT1, a primary coil T2-1 of a drive transformer T2, a secondary coil CT2-2 of a balance transformer CT2, and a primary coil T3-1 of a drive transformer T3 are connected in series. Both ends of the series-connection are connected to a connecting mid-point of the transistors TR1 and TR3 shown in FIG. 1 and a connecting mid-point of the transistors TR2 and TR4 shown in FIG. 1, respectively. In each of the secondary coils T1-2 to T3-2 of the drive transformers T1 to T3 is connected to respective of series circuits of cold cathode discharge tubes FL1 to FL3 and resistors R1 to R3, and another is directly connected to ground as shown in FIG. 2.

Further, the drive circuit block B is also configured to include three drive transformers T4, T5, and T6, and two balance transformers CT3 and CT4. A primary coil T4-1 of a drive transformer T4, a secondary coil CT3-2 of a balance transformer CT3, a primary coil T5-1 of a drive transformer T5, a secondary coil CT4-2 of a balance transformer CT4, and a primary coil T6-1 of a drive transformer T6 are connected in series. Both ends of the series-connection are connected to the connecting mid-point of the transistors TR1 and TR3 shown in FIG. 1 and the connecting mid-point of the transistors TR2 and TR4 shown in FIG. 1, respectively. Similar to the drive circuit block A, in each of the secondary coils T4-2 to T6-2 of the drive transformers T4 to T6 is connected to respective of series circuits of cold cathode discharge tubes L4 to L6 and resistors R4 to R6, and another is directly connected to ground in the drive circuit block B as shown in FIG. 2.

In the discharge tube drive circuit according to the second embodiment of the present invention, when a voltage Vin is applied from the switching circuit, a divided voltage Vin/3 is applied to the primary coils T1-1 to T3-1 of the drive transformers T1, T2, and T3 in the drive circuit block A. Further, the four primary coils CT1-1 to CT4-1 of the balance transformers CT1 to CT4 are connected to the output of the full-bridge type switching circuit, so that a voltage Vin/4 is to be applied to each of the primary coils CT1-1 to CT4-1 of the balance transformers CT1 to CT4.

Therefore, a voltage of 2×Vin/3 lacks at each the primary coil of the balance transformers CT1 to CT3, so that it is necessary to design the balance transformer as to supply a voltage 2×Vin/3 to each primary coil of the drive transformers. Then, a voltage Vin is to be applied to each primary coil of the drive transformers.

In this case, a voltage of 2×Vin/3 lacks at each of the three drive transformers, so that a voltage of 3×2×Vin/3=2×Vin becomes necessary. According to the second embodiment, it is necessary to output a voltage Vin per one balance transformer, since each drive circuit block is configured to include two balance transformers. Accordingly, it is preferable to set the turn ratio for each balance transformer to be 1:4.

Third Embodiment

Figure 3:
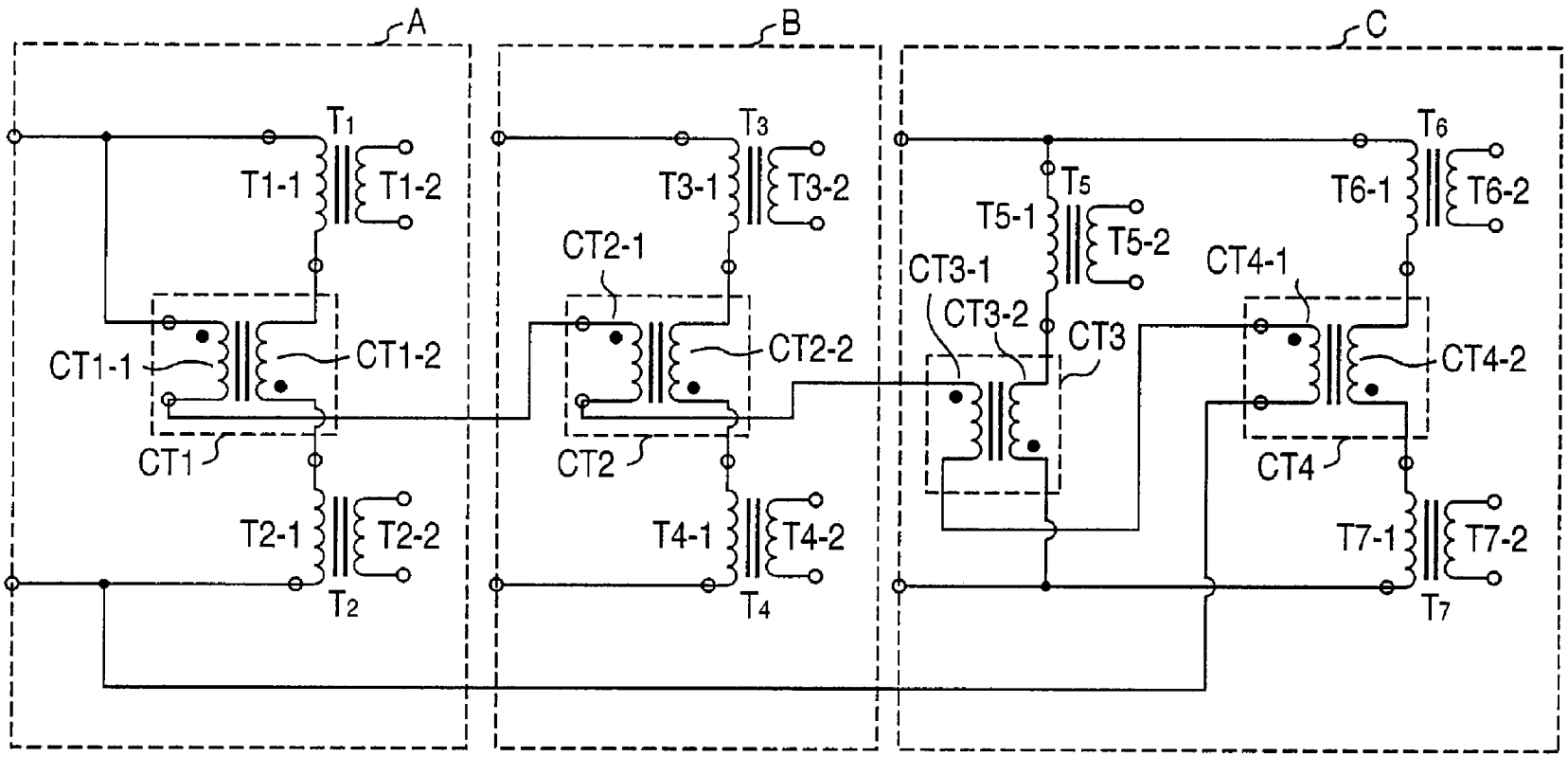
FIG. 3 shows a circuit diagram of a discharge tube drive circuit according to a third embodiment of the present invention.

Now, with reference to FIG. 3, a discharge tube drive circuit for driving seven cold cathode discharge tubes according to a third embodiment of the present invention. Also the embodiment in FIG. 3, the control section 3, the switching circuit, and the cold cathode discharge tubes which are common to the first embodiment are neglected.

Although the portion common to the portion in FIG. 1 is omitted, the discharge tube drive circuit according to the third embodiment in FIG. 3 basically comprises three drive circuit blocks A, B, and C. The drive circuit block A comprises two drive transformers T1 and T2, and one balance transformer CT1. The drive circuit block B is configured to include two transformers T3 and T4, and one balance transformer CT2. On the contrary, the drive circuit block C is configured to include three drive transformers T5, T6, and T7, and two balance transformers CT3 and CT4. The primary coils CT1-1 to CT4-1 of all the balance transformers CT1 to CT4 are connected in series. Both ends of the series-connection circuit are connected to a connecting mid-point of the transistors TR1 and TR3 and a connecting mid-point of the transistors TR2 and TR4, respectively as shown in FIG. 1. Turn ratio of these balance transformers CT1 to CT4 is set to be 1:4.

In this case, the impedance value observed from each primary coil of the balance transformers CT1, CT2, and CT4 are connected in series with the drive transformers T1 to T4, T6, and T7. However, the impedance value observed from the primary coil of the balance transformer CT3 connected to the drive transformer T5 is different from the impedance values of the balance transformers CT1, CT2, and CT4. Thus, when four primary coils CT1-1 to CT4-1 of the 4 balance transformers CT1 to CT4 are connected in series, a voltage applied across each of the balance transformers CT1 to CT4 is divided depending on the impedance values. Accordingly, a lower voltage than a voltage applied to other balance transformers is applied to the primary coil CT3-1 of the balance transformer CT3 by conforming the currents flowing through the secondary coils CT1-2 to CT4-2 of the balance transformers CT1 to CT4. Thereby, also in the discharge tube drive circuit of this third embodiment in FIG. 3, the currents flowing through each of the drive transformers are adjusted to be equal by boosting the voltage applied to the all primary coils T1-1 to T7 of the all drive transformers t1 to T7.

To describe the above more in detail with equations, for example, the drive transformers T1 to T7 FIG. 3 may be replaced with resisters R1 to R7 as the impedance values observed from the primary coil side of the each drive transformer, the current flowing through each of the drive transformers T1 and T2 is defined as I1, the current flowing through each of the drive transformers T3 and T4 is defined as I2, the current flowing through the drive transformer T5 is defined as I3, and the current flowing through each of the drive transformers T6 and T7 is defined as I4. Further, the voltages appeared at the secondary coils CT1-1 to CT4-1 of the balance transformers CT1 to CT4 are defined as V1, V2, V3, and V4, respectively, and the turn ratio of each of the primary coils CT1-1 to CT4-1 and the secondary coils CT1-2 to CT4-2 of the balance transformers CT1 to CT4 is defined as 1:4. According to the above defined relations, following equations are established.

$$R1\times I1+R2\times I1+V1=Vin \quad (1)$$

$$R3\times I2+R4\times I2+V2=Vin \quad (2)$$

$$R5\times I3+V3=Vin \quad (3)$$

$$R6\times I4+R7\times I4+V4=Vin \quad (4)$$

In this case, all primary coils of the balance transformers CT1 to CT4 are connected in series. Thereby, the current flows common to all primary coils of the balance transformers CT1 to CT4, so that the currents flowing through each of secondary coils of the balance transformers CT1 to CT4 are made to be equal.

Accordingly, a following equation is established.

$$I1=I2=I3=I4=I \quad (5)$$

Further, the drive transformers T1 to T7 are replaced with the resisters R1 to R7 as the impedance value observed from the primary coil side of each drive transformer, and if these impedance values are equal and if each impedance value is replaced with RI, a following equation is established.

$$RI+RI+V1=Vin \quad (1')$$

$$RI+RI+V2=Vin \quad (2')$$

$$RI+V3=Vin \quad (3')$$

$$RI+RI+V4=Vin \quad (4')$$

From equations (1), (2), and (4), a following equation is established.

$$V1=V2=V4 \quad (6)$$

Accordingly, the voltages generated and appeared at the secondary coils of the balance transformers CT1, CT2, and CT4 become equal.

Further, with regard to the V3, a following is established.

$$2\times RI+V1=Vin \quad (1')$$

$$RI+V3=Vin \quad (3')$$

The, form the equations (1') and (3'), a following is established.

$$2\times V3-V1=Vin \quad (7)$$

In addition, the primary coils of the balance transformers CT1 to CT4 divide the voltage Vin, so that a following is established.

$$-(V1/4+V2/4+V3/4+V4/4)=Vin \quad (8)$$

In this case, the turn ratio of the balance transformer is 1:4, so that a factor 1/4 is multiplied to each of V1 to V4 in the above equation. Further, the primary coil and the secondary coil of the balance transformer are out of phase, so that a polarity becomes −(minus) sign.

the equation (8) is modified from the equation (6), then, $$-(3\times V1/4+V3/4)=Vin \quad (8')$$

is established. Further from the equations (7) and (8'), $$V1=-27/21Vin=V2=V4 \quad (9)$$

is established, and accordingly, $$V3=-1/7Vin \quad (10)$$

is established.

Accordingly, a voltage is divided at balance transformers CT1 to CT4 depending on the impedance value observed from the primary coil side of the balance transformer in order to conform the currents, so that it is possible to boost the voltage to respective coil depending on the turn ratio.

Fourth Embodiment

Figure 4:
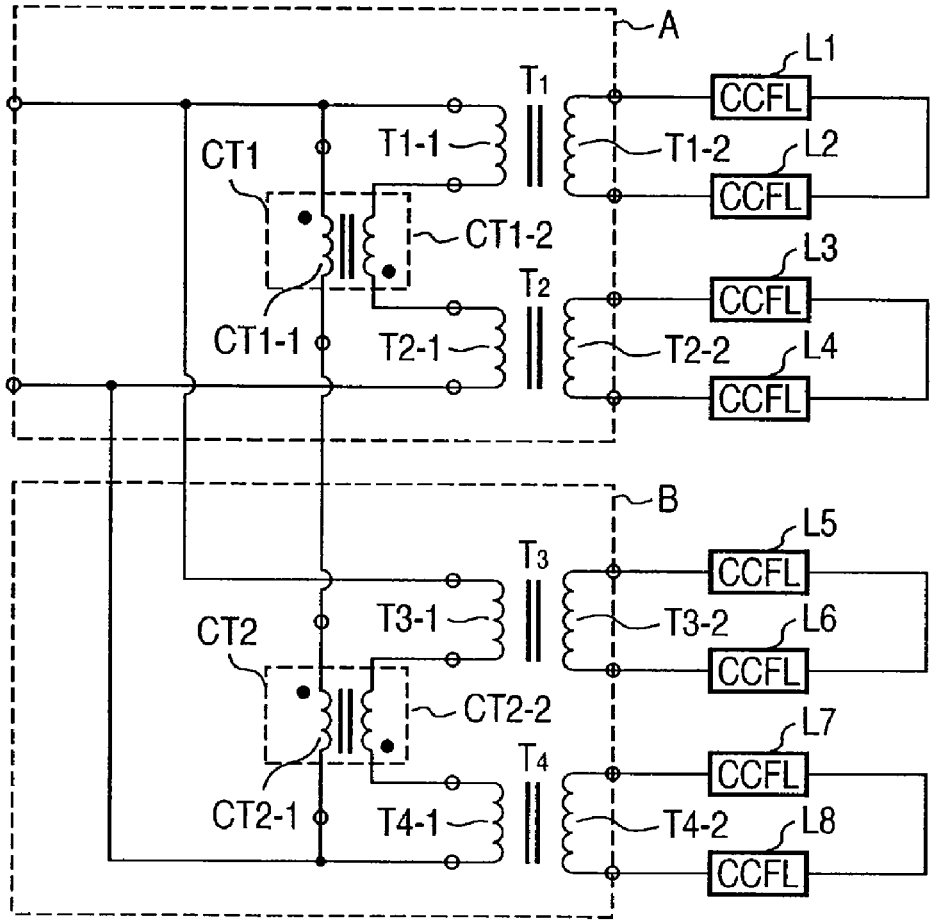
FIG. 4 shows a circuit diagram of a discharge tube drive circuit according to a forth embodiment of the present invention.

Now, with reference to FIG. 4, a discharge tube drive circuit for driving eight cold cathode discharge tubes according to fourth embodiment of the present invention is described. Also in the fourth embodiment, the control section 3 and the switching circuit which are common to the first embodiment are neglected. Further, in FIG. 4, two straight type cold cathode discharge tubes are connected in series, and are used as a quasi-U-shaped cold cathode discharge tube. In FIG. 4, although portions similar to the portions in FIG. 1 are neglected, the discharge tube drive circuit is configured with two drive circuit blocks A and B. The drive circuit block A is configured to include two drive transformers T1 and T2, and one balance transformer CT1. The drive circuit block B is configured to include two transformers T3 and T4, and one balance transformer CT2. The primary coils CT1-1 and CT2-1 of the two balance transformers CT1 and CT2 are connected in series, and both ends of the series connection are connected to a connecting mid-point of the transistors TR1 and TR3 in FIG. 1 and a connecting mid-point of the transistors TR2 and TR4 in FIG. 1, respectively.

As will be understand from the drawing, in the discharge tube drive circuit according to the fourth embodiment of the present invention, it is possible to configure the discharge tube drive circuit with only two balance transformers for driving eight cold cathode discharge tubes, so that the number of balance transformers can be reduced.

Fifth embodiment

Figure 5:
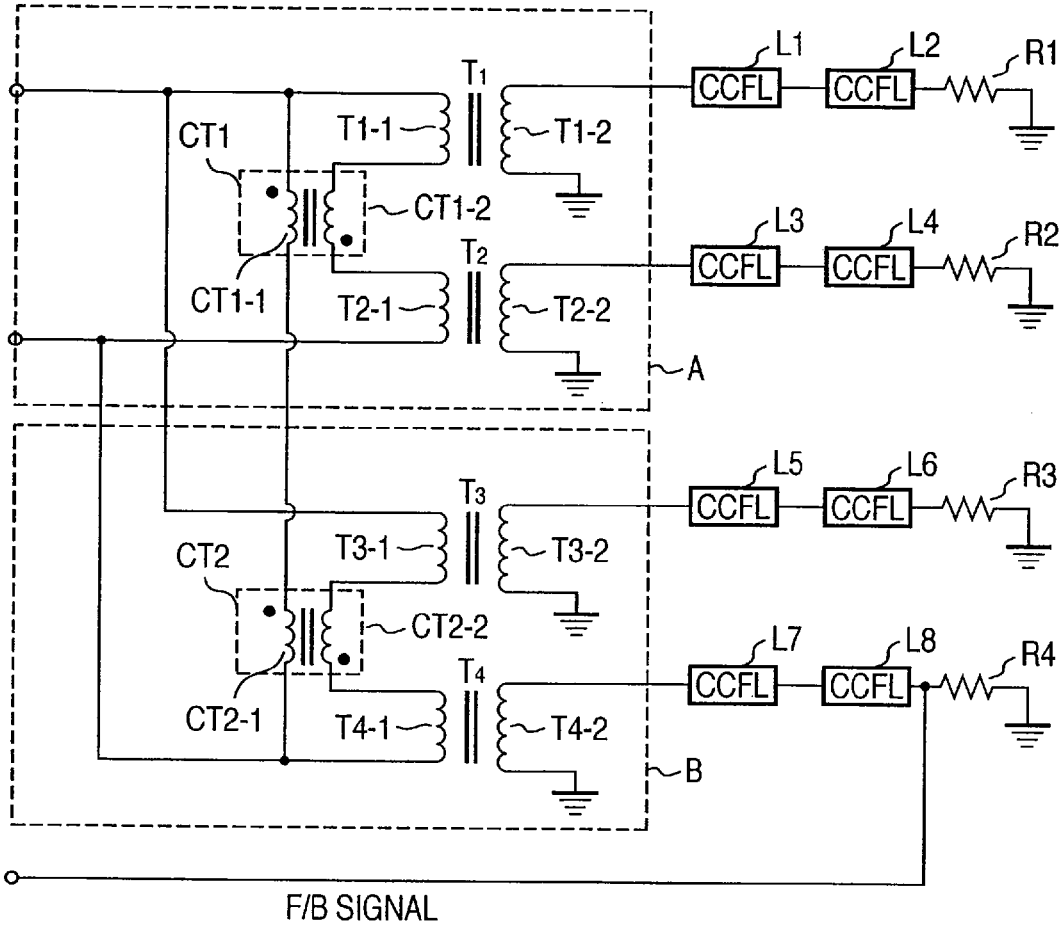
FIG. 5 shows a circuit diagram of a discharge tube drive circuit according to a fifth embodiment of the present invention.

Further, with reference to FIG. 5, a fifth embodiment of a discharge tube drive circuit for driving eight cold cathode discharge tubes according to the present invention is described. Although a portion similar to the portion in FIG. 1 is neglected, this fifth embodiment is also configured with basically two drive circuit blocks A and B. The drive circuit block A is configured to include two drive transformers T1 and T2, and one balance transformer CT1. The drive circuit block B is configured to include two transformers T3 and T4, and one balance transformer CT2. The primary coils CT1-1 to CT2-1 of the two balance transformers CT1 and CT2 are connected in series, and both ends of the series-connection are connected to a connecting mid-point of the transistors TR1 and TR3 in FIG. 1 and a connecting mid-point of the transistors TR2 and TR4 in FIG. 1, respectively.

Similar to the discharge tube drive circuit described in the fourth embodiment, the discharge tube drive circuit of this fifth embodiment is possible to be configured to include two balance transformers CT1 and CT2 for eight cold cathode discharge tubes, so that it becomes possible to reduce the number of balance transformers in the discharge tube drive circuit.

Sixth Embodiment

Figure 6:
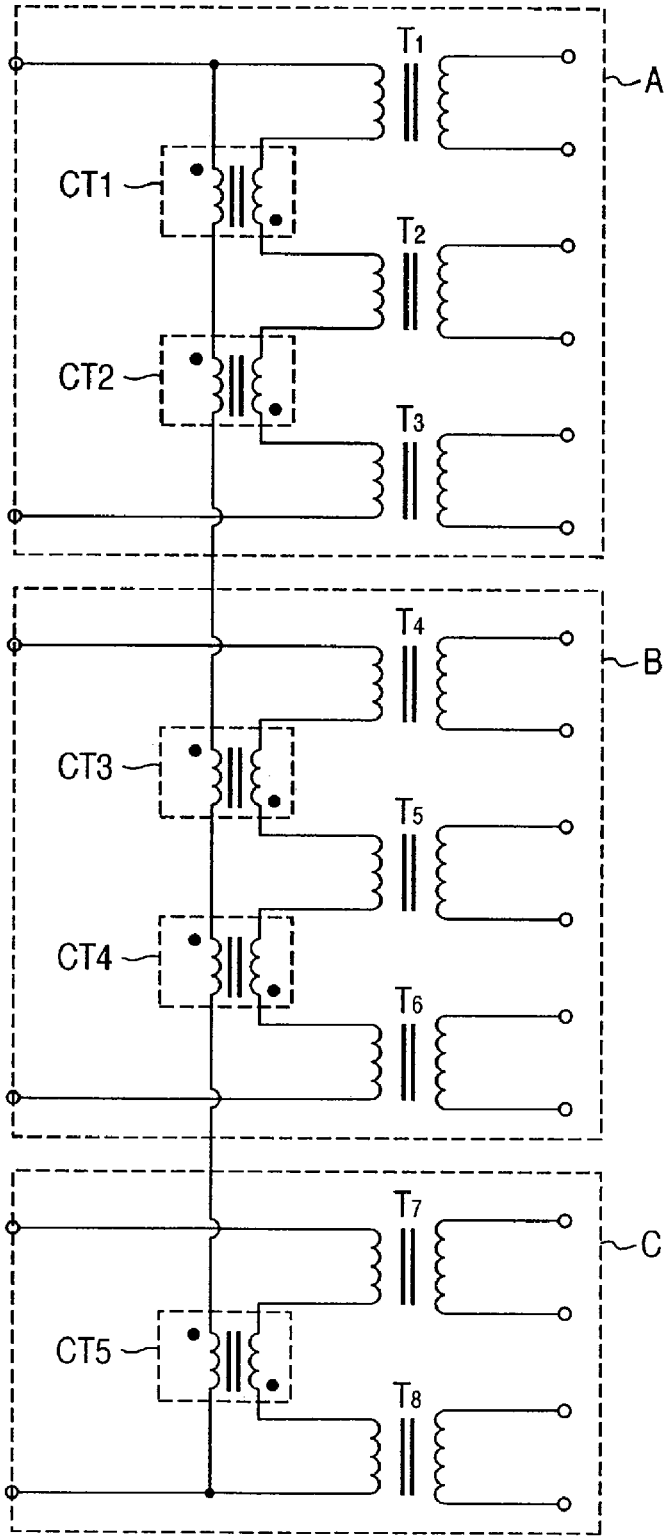
FIG. 6 shows a circuit diagram of a discharge tube drive circuit according to a sixth embodiment of the present invention.

Now, with reference to FIG. 6, a sixth embodiment of a discharge tube drive circuit according to the present invention is described.

The discharge tube drive circuit of this sixth embodiment is basically configured to include three drive circuit blocks A, B and C, and is possible to configure a discharge tube drive circuit for driving eight cold cathode discharge tubes using eight drive transformers T1 to T8 and five balance transformers CT1 to CT5.

Seventh Embodiment

Figure 7:
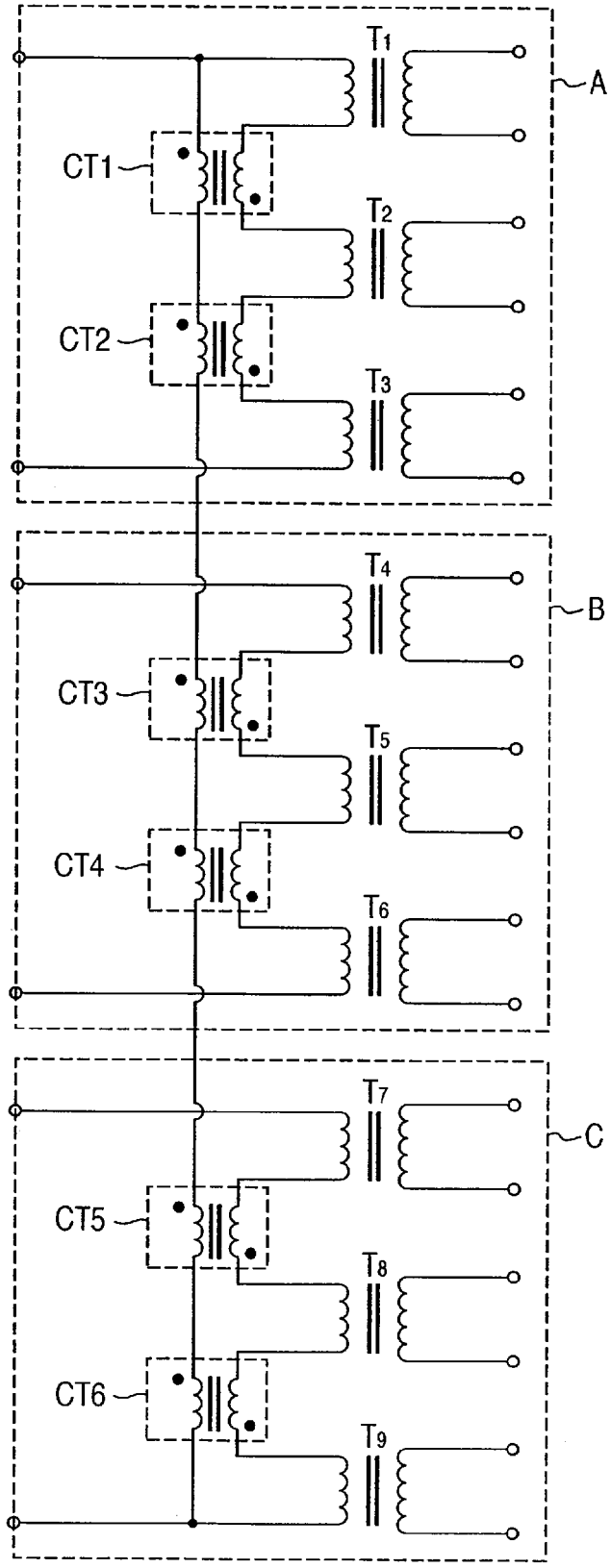
FIG. 7 shows a circuit diagram of a discharge tube drive circuit according to a seventh embodiment of the present invention.

FIG. 7 illustrates a discharge tube drive circuit according to a seventh embodiment of the present invention. The discharge tube drive circuit of this seventh embodiment is basically configured to include three drive circuit blocks A, B and C, and is possible to configure a discharge tube drive circuit for driving nine cold cathode discharge tubes using nine drive transformers T1 to T9 and six balance transformers CT1 to CT6.

OTHER EMBODIMENT

Figure 8:
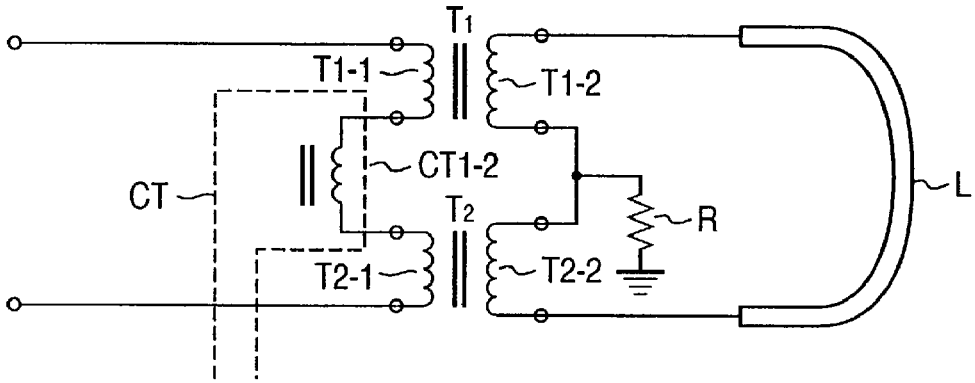
FIG. 8 shows a circuit diagram of a modified discharge tube drive circuit of each embodiment including drive circuit section having available drive transistors of the preceding embodiments according to the other embodiment of the present invention.

Now, with reference to FIG. 8, the other embodiments of the present invention are described. In FIG. 8, a part of a drive circuit employing an U-shaped cold cathode discharge tube is illustrated, and which is replaceable with the part of drive circuit including two drive transformers as mentioned in each of first to seventh embodiments. In this circuit, the primary coils T1-1 and T2-1 of the drive transformers T1 and T2 are connected in series while sandwiching one of the coils of the balance transformer CT. In addition, the secondary coils T1-2 and T2-2 of the drive transformers T1 and T2 are connected in series, and an U-shaped cold cathode discharge tube is connected at both ends of the series-connection. Further, a connecting mid-point of the secondary coils T1-2 and T2-2 are connected to ground through a resistor R. In this case, another coil of the balance transformer CT is inserted in another drive circuit (not shown).

The present invention may be implemented by replacing partially with a circuit in each of the first to seventh embodiments. The present invention is particularly effective to a LCD panel which requires to evenly light a number of cold cathode discharge tubes.

Each of embodiments of the present invention is described as above, but the discharge tube drive circuit of the present invention is not limited to the above embodiments, and many modified form may also be available. For example, a full-bridge type circuit is shown, but a half-bridge type circuit, and other type circuit may be used as a switching circuit. The control unit 3 maybe configured with a plurality of control units, and may be configured with a self-oscillation type circuit. Further in the illustrated embodiments, each of the drive transformers T1 to T7 is configured to include a single primary coil and a single secondary coil. However, each of the drive transformers T1 to T7 may be replaced with a transformer having a single primary coil and two or more secondary coils, and their combination may also be used to configure a drive circuit. Further, in the illustrated embodiments, the secondary coil of the balance transformer is configured to be provided between the primary coils of the drive transformers T1 and T2, but may be connected to another portion of the primary coils of the drive transformers T1 and T2, provided that these coils are connected in series.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-103480, filed Apr. 4, 2006, which is hereby incorporated by reference herein in its entirety.

The invention claimed is:

1. A discharge tube drive circuit comprising:

a first and a second drive circuit blocks each having a plurality of drive transformers, the drive transformers each having secondary coils connected to at least a discharge tube;

a plurality of switches which forms an inverter for generating high frequency signals; and a control unit for controlling said plurality of switches, wherein said first drive circuit block includes at least a first balance transformer provided at a primary coil side of the plurality of drive transformers in said first drive circuit block;

wherein a plurality of primary coils of the plurality of drive transformers in the first drive circuit block and a secondary coil of the first balance transformer are connected in series;

wherein said second drive circuit block includes at least a second balance transformer provided at a primary coil side of the plurality of drive transformers in said second drive circuit block;

wherein a plurality of primary coils of the plurality of drive transformers in said second drive circuit block and a secondary coil of the second balance transformer are connected in series; and wherein primary coils of the first and second balance transformers are connected in series.

2. The discharge tube drive circuit according to claim 1, wherein said balance transformer is configured to have a primary coil and a secondary coil having a turn ratio of 1:N, wherein N is positive integer corresponding to a number of drive transformers connected to the secondary coil of the balance transformer.

3. The discharge tube drive circuit according to claim 2, wherein (N−1) balance transformers are provided with regard to the primary coils of the series-connected N drive transformers in each of said drive circuit blocks.

4. The discharge tube drive circuit of claim 1 wherein the secondary drive coils of said drive transformers are connected to at least one respective discharge tube without another transformer disposed operatively inbetween.

5. A discharge tube drive circuit including a plurality of drive transformers for driving a plurality of discharge tubes connected to secondary coils of the plurality of drive transformers, comprising:

at least two drive circuit blocks being formed by dividing said plurality of drive transformers, and including at least a balance transformer provided at a primary side of the plurality of drive transformers, respectively, wherein primary coils of the drive transformers are connected in series to a secondary coil of the balance transformer between output terminals of an inverter in each of said drive circuit blocks; the inverter including a plurality of switches; and wherein primary coils of the balance transformers are connected in series between output terminals of the inverter.

6. The discharge tube drive circuit according to claim 5, wherein said balance transformer is configured to have a primary coil and a secondary coil having a turn ratio of 1:N, wherein N is positive integer corresponding to a number of drive transformers connected to the secondary coil of the balance transformer.

7. The discharge tube drive circuit according to claim 6, wherein (N−1) balance transformers are provided with regard to the primary coils of the series-connected N drive transformers in each of said drive circuit blocks.

8. The discharge tube drive circuit of claim 5 wherein the secondary drive coils of said drive transformers are connected to said discharge tubes without another transformer disposed operatively inbetween.

9. A discharge tube drive circuit for driving a LCD panel having a plurality of discharge tubes comprising:

a plurality of drive circuit blocks for lighting said plurality of discharge tubes;

a switching circuit having a plurality of switches and connected in parallel to the plurality of drive circuit blocks;

wherein each of said plurality of drive circuit blocks includes N drive transformers in which primary coils of the N drive transformers are connected in series and each of the secondary coils of the N drive transformers is connected to at least a discharge tube, wherein N is a positive integer; and wherein each of said plurality of drive circuit blocks includes (N−1) balance transformers provided at a primary coil side of the N drive transformers; wherein, in each of said plurality of drive circuit blocks, the number of drive transformers is related to the number of balance transformers by the ratio of N:(N−1); wherein secondary coils of the (N−1) balance transformers and the primary coils of the N drive transformers are connected in series to the switching circuit and each of the primary coils of the (N−1) balance transformers is connected in series to the switching circuit in order to conform currents flowing through said each of the drive circuit blocks.

10. The discharge tube drive circuit according to claim 9, wherein said balance transformer is configured to have a primary coil and a secondary coil having a turn ratio of 1:N.

11. The discharge tube drive circuit of claim 9 wherein said secondary drive coils of said drive transformers are connected to said at least a discharge tube without another transformer disposed operatively inbetween.

* * * * *